United States Patent [19]

Iwata et al.

[11] Patent Number: 4,889,557

[45] Date of Patent: Dec. 26, 1989

[54] ALUMINIUM ALLOY HAVING AN EXCELLENT FORGIABILITY

[75] Inventors: Yasuo Iwata; Shigenori Mae; Yoshio Urai; Takayuki Tsunoda, all of Toyota, Japan

[73] Assignee: Toyota Jidosha Kabushiki Kaisha, Aichi, Japan

[21] Appl. No.: 172,561

[22] Filed: Mar. 24, 1988

[30] Foreign Application Priority Data

Mar. 30, 1987 [JP] Japan ..... 62-077144

[51] Int. Cl.[4] ..... C22C 21/00

[52] U.S. Cl. ..... 75/249; 123/193 CP; 419/41; 419/48

[58] Field of Search ..... 75/249; 123/193 CP; 419/41, 48

[56] References Cited

U.S. PATENT DOCUMENTS

| | | | |
|---|---|---|---|
| 2,024,767 | 12/1935 | Jeffries et al. | 75/249 |
| 4,135,922 | 1/1979 | Cebulak | 75/249 |
| 4,205,649 | 6/1980 | Ostermann et al. | 123/193 CP |
| 4,435,213 | 3/1984 | Hildeman et al. | 75/249 |
| 4,537,167 | 8/1985 | Eudier et al. | 75/249 |
| 4,702,885 | 10/1987 | Odani et al. | 419/23 |
| 4,711,823 | 12/1987 | Shiina | 419/48 |
| 4,732,610 | 3/1988 | Hildeman et al. | 75/249 |

FOREIGN PATENT DOCUMENTS 131945 7/1985 Japan .

*Primary Examiner*—Stephen J. Lechert, Jr.
*Attorney, Agent, or Firm*—Kenyon & Kenyon

[57] ABSTRACT

An aluminium alloy made of consolidated rapid-quenched aluminium alloy powder by using an improved metallurgical method basically comprises, by weight percent, less than 30% silicone, less than 8% iron, less than 7% copper and less than 0.2% oxygen, the balance being substantially aluminium. The consolidated rapid-quenched aluminium alloy powder has features that it contains less than 0.2% oxygen, and the material made from the rapid-quenched aluminium alloy powder has a high limit compressibility factor, rate of reduction and tensile strength. Thus the aluminium alloy material obtained is suitable for structural members such as pistons for internal combustion engines.

3 Claims, 2 Drawing Sheets

ALUMINIUM ALLOY HAVING AN EXCELLENT FORGIABILITY

BACKGROUND OF THE INVENTION

1. Field of The Invention

This invention relates to an aluminium alloy having an excellent forgeability and more particularly to an aluminium alloy suitable to make a piston for an internal-combustion engine.

2. Description of the Prior Art

Conventionally, in the field of aluminium alloy working technology for producing pistons for internal-combustion engines, a casting method has been known.

Recently, however, a powder metallurgical method attracts a good deal of attention instead of the conventional casting method.

The reason for this tendency is that the powder metallurgical method can give a wider range of selection of added elements as compared with the casting method. According to this powder metallurgical method, it is preferable to use a consolidated rapid-quenched aluminium alloy powder. The consolidated rapid-quenched aluminium alloy powder employed in the above metallurgical method is made by rapidly quenching a molten aluminium alloy at cooling rates of $10^3$–$10^7$ °C./sec. which are $10^2$–$10^5$ times faster than those of the conventional aluminium alloy casting.

Consequently, the solid solution of the alloying elements of the consolidated rapid-quenched aluminium alloy powder in the metallurgical method is highly oversaturated. Therefore, the aluminium alloy product which is made of the consolidated rapid-quenched aluminium alloy powder has excellent mechanical characteristics, such as a superior abrasion resistance and high-temperature resistance unobtainable by conventional aluminium alloy casting. The Japanese Unexamined published patent application No. 131945/1985, for instance, discloses a technique for making aluminium alloy products by such a metallurgical method.

According to such an aluminium alloy product as disclosed in the Japanese Unexamined published patent application No. 131945/1985, there are cases where cracks develop on the product when it is made by forging. It is conceived that such cracks may have been caused by insufficient flexibility of the forged aluminium alloy product.

SUMMARY OF THE INVENTION

An object of this invention is therefore to provide a new and improved aluminium alloy which has an excellent forgeability being free from the disadvantages of the prior art.

The aluminium alloy of the present invention made of the consolidated rapid-quenched aluminium alloy powder comprises, by weight, less than 30% silicon, less than 8% iron, less than 7% copper, and less than 0.2% oxygen, the balance being substantially aluminium. The term consolidated as used herein means that the powder is in the solidified state to make a lump.

The aluminium alloy according to the present invention is made by a metallurgical method using the consolidated rapid-quenched aluminium alloy powder.

That is; the aluminium alloy is made by the process as follows:

1. The rapid-quenched aluminium alloy powder is formed into a green compact by such means as press, Cold Isostatic Pressing (CIP).

2. The green compact is put in a suitable covering member and heated at a temperature between 400°–500° under an evacuated atmosphere of $10^{-3}$–$10^{-5}$ torr. Then the green compact is shielded in the covering member.

3. The green compact is then hot extruded with the covering member.

4. The resulting extruded aluminium alloy is exposed by peeling the covering member off.

Further, according to the present invention, it is possible to use the consolidated rapid-quenched aluminium alloy powder which is made by an atomization process. In this case, however, it is preferable to use the consolidated rapid-quenched aluminium alloy powder of which more than 90 weight percent consists of particles with their average diameter less than 297 μm.

The following explains roles of the aforementioned alloying elements, and significance of the composition and characteristics of the inclusion particles.

iron: less than 8%, preferably 3%–8%

Iron is essential for assuring a high temperature strength, adiabatic efficiency and Young's modulus to the aluminium alloy for structural use. When present by more than 8%, the specific gravity becomes too large, which tends to affect unfavorably the lightness and moldability in the hot forging, both of which are features of the aluminium alloy.

silicon: less than 30%, preferably 10%–30%

Silicon is effective for increasing abrasion resistance which is not attained by an addition of only iron and for improving Young's modulus.

However, excess amount of silicon remarkably damages impact strength, causing cracks in the extrusion process. Therefore, the content should be limited to 30% at highest, but not less than 10% to ensure a high abrasion resistance.

copper: less than 7%, preferably 2%–7%

Copper is an essential element primarily to compensate for the decrease in sintering feasibility due to additions of iron and silicon. Too much content more than 7%, however, causes a decline of the high temperature resistance of the aluminium alloy.

oxygen: less than 0.2%, preferably 0%–0.2%

Too much oxygen content more than 0.2% tends to decrease the forgeability, the limit compressibility factor and the rate of reduction. Oxygen content of the aluminium alloy becomes a little more than 0.4% when the hot extrusion is conducted in the atmosphere, a little less than 0.1% when hot extrusion is conducted in an inert gas atmosphere, and a little less than 0.2% when it is conducted by putting the compact in a pipe, heated under vacuum and hot extruded within the pipe after shielding the pipe. For this reason, the compact should be heated under vacuum for degassing and extruded within some suitable shielding member. And it is preferably oxygen content should be made as little as possible in the range between 0 to 0.2%.

In the case of using a pipe as a shielding member, a pipe made of steel or aluminium is usable. Removal of such pipe after hot extrusion process can be made by cutting and so on.

One of the advantages of this invention is that it makes possible to obtain an aluminium alloy having a high limit compressibility factor of more than 40 $\epsilon f$ (%) and a high rate of reduction of more than 23 $\phi$ (%). In addition, a piston which is made of the aluminium alloy of this invention by forging assures an improved tensile strength of more than 20 kg/mm$^2$ and a high rate of reduction more than 10%. Here, the rate of reduction $\phi$ is given by the following equation. A higher rate of reduction means longer elongation.

$$\phi = \frac{\text{cross sectional area of resulting cut off surface of a test piece after a tension test}}{\text{cross sectional area of a test piece before a tension test}}$$

For these reasons, it can be said that the aluminium alloy according to this invention has an excellent forgeability and therefore is suitable for producing structural members such as pistons for an internal-combustion engine.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
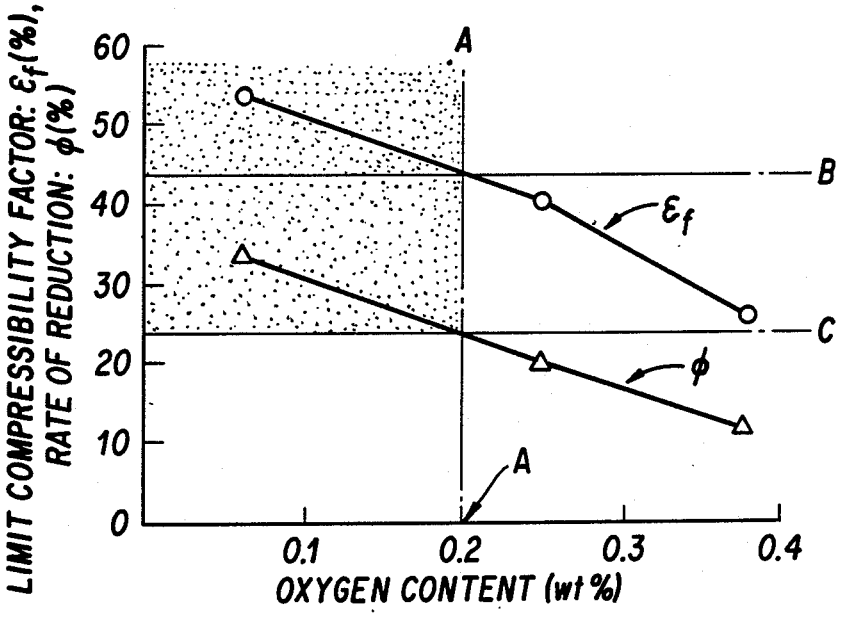
FIG. 1 is a graph showing the relations between oxygen content and limit compressibility factor, and between oxygen content and rate of reduction.

Various other objects, features and attendant advantages of the present invention will be more fully appreciated as the same becomes better understood from the following detailed description when considered in connection with the accompanying drawings.

As a first step of producing the aluminium alloy of the present invention, consolidated rapid-quenched aluminium alloy powder was made from molten aluminium alloy by a rapid cooling. The cooling rate was in the range of $10^3$ to $10^7$ °C./sec.

The composition of the consolidated rapid-quenched aluminium alloy powder comprised by weight percent: 20% silicon, 4.8% iron, 2.2% copper, 1.2% magnesium and 1.1% manganese. Average particle diameter was in the range of 80 to 100 μm.

Next, using a compressive mold, the consolidated rapid-quenched aluminium alloy powder was formed into a cylindrical green compact. The range of pressing pressure required was 10kg/cm$^2$- 20kg/cm$^2$. The size of the green compact was approximately $\phi 250 \times 800$ mm.

Then, the green compact was put in a pipe of aluminium and heated at 400°-500° C. for 10-30 minutes under a vacuum of $10^{-3}$-$10^{-5}$ torr.

After this heating step, the green compact was shielded within the pipe and hot extruded. Percentage reduction of cross-sectional area was set to be in the range of 70-90%, and temperature when extruded was set to 350°-500° C. This hot extrusion was conducted by using dies. Thus, an extrusion molded product, namely extruded aluminium alloy, was shaped. The diameter of the resulting extruded aluminium alloy was 75mm.

Thus the aluminium alloy of the present invention was produced. The resulting extruded aluminium alloy was measured to have 0.06 weight % of oxygen.

For comparison, a green compact made of the same aluminium alloy powder was heated at 400°-500 ° C. for 10-30 minutes in an argon gas atmosphere. Then the heated green compact was directly hot extruded in the argon gas atmosphere without shielding the compact in a pipe. The resulting extruded aluminium alloy was measured to have 0.25 weight % of oxygen.

For another comparison, a green compact made of the same aluminium alloy powder was heated at 400°-500° C. for 10-30 minutes in the air. Then the heated compact was directly extruded in the air without shielding the compact in a pipe. The resulting extruded aluminium alloy was measured to have 0.38 weight % of oxygen.

Experiments have been conducted to test the forgeability of each of the extruded aluminium alloys The forgeability test was to measure a limit compressibility factor, and a rate of reduction of each of the extruded aluminium alloys.

It is to be noted that the above test on the limit compressibility factor was conducted in accordance with the test method specified by the Forging Subcommittee of the Plastic Working Academic Society. That is, the test piece employed was No. 1 test piece specified by the Forging Subcommittee. It had a length of 45 mm and a diameter of $\phi$ 30. The ratio between length and diameter of the test piece was 1.5. As a compression test, both ends of the test pieces were contacted and pressed with end surface defining plates. Each of the test pieces was heated at 450°-480 ° C. in a heating furnace. The strain speed of the test pieces was in the range of 0.11-0.16.

In the test on the rate of reduction, the test was conducted after each of the test pieces was maintained at 450° C. for 15 minutes. The temperature of the drawing die was in the range of 150°-200 ° C. The drawing speed was 2mm/sec.

The test results are illustrated in FIG. 1, wherein Ef(0) indicates a characteristic curve between oxygen content and a limit compressibility factor, and $\phi(\Delta)$ indicates a characteristic curve between oxygen content and rate of reduction.

As shown by the characteristic curves Ef and $\phi$ in FIG. 1, when oxygen content is over 0.2%, the limit compressibility factor becomes less than 43%, and the rate of reduction becomes less than 24%. This means that oxygen content should be less than 0.2%.

Under the conditions where the limit compressibility factor is less than 43%, and the rate of reduction is less than 24%, the extruded aluminium alloy of the present invention is forgeable without any cracks even when hot forging is conducted.

Next pistons were made from these three kinds of extruded aluminium alloys mentioned above. Namely, each of the extruded products was cut to a given size of $\phi 35 \times 82.8$ mm, and each of the cut off bodies was heated again at 400°-500° C. for 10-30 minutes. Then, each of the heated bodies was hot forged by using a forging die to form a forged rough piston. The range of pressure when forging was 60 kg/mm$^2$-100 kg/mm$^2$. In general, percentage reduction of cross-sectional area of the resulting product differs from portion to portion of the product. In case of this piston, the percentage was about 80% at the maximum.

Figure 3:
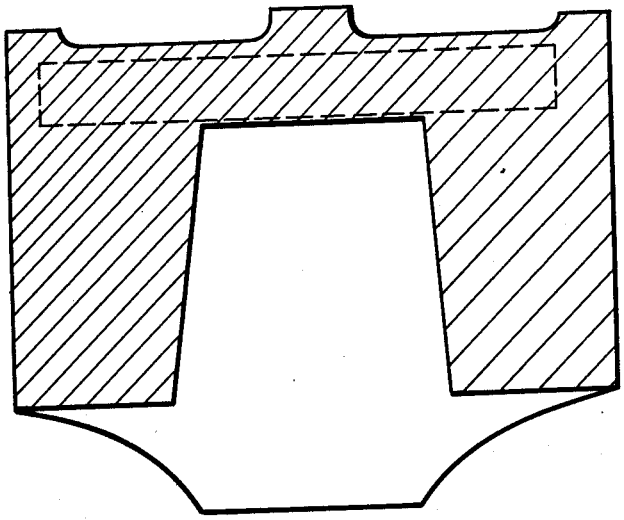
FIG. 3 is a vertical cross sectional view of a piston.
Figure 4:
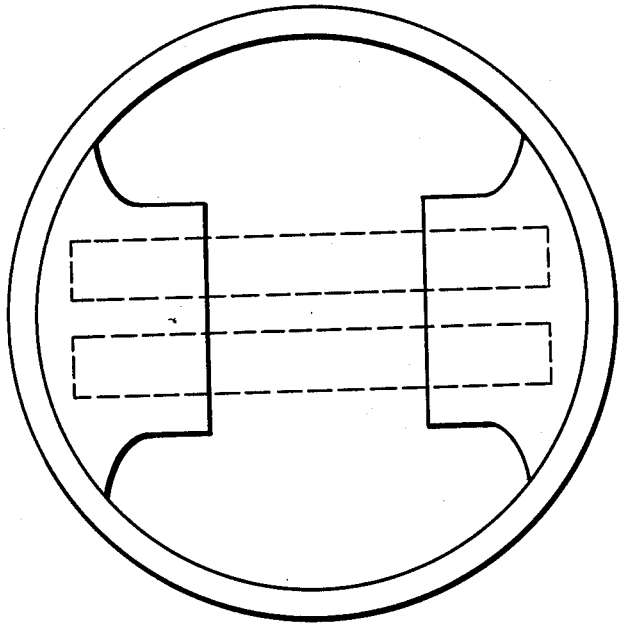
FIG. 4 is a plan view of the piston shown in FIG. 3.

The forged rough piston is shown in FIGS. 3 and 4. FIGS. 3 and 4 are a vertical cross sectional view and a plan view of the piston respectively.

In order to check the toughness of each of the forged rough pistons, test pieces were made by cutting the top portions as shown in broken lines of FIGS. 3 and 4 out of the forged rough pistons. These test pieces were heated at 475° C. for 2 hours for solution annealing, then put in hot water of 60° C. for quenching and heated at 170° C. for 6 hours for age hardening.

After these processes, the tensile tests were conducted by pulling each of the pieces at a tensile speed of 20 min/sec.

Figure 2:
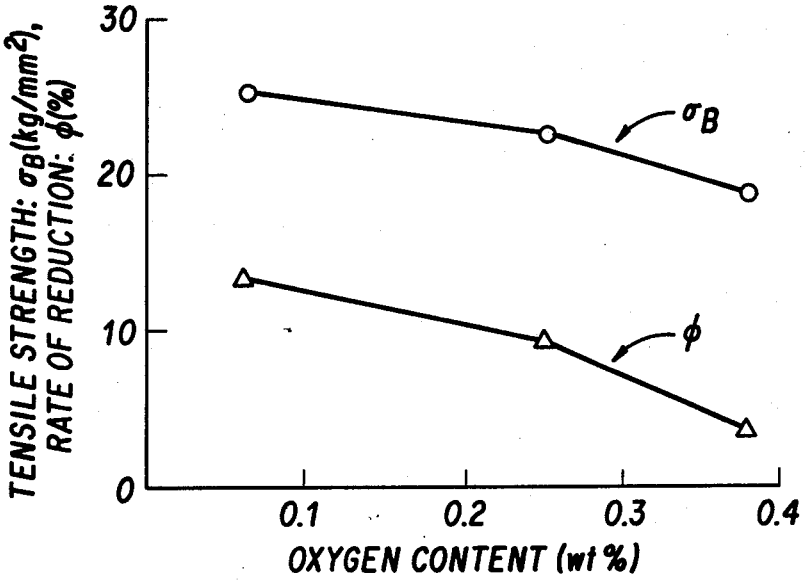
FIG. 2 is a graph showing the relations between oxygen content and tensile strength, and between oxygen content and rate of reduction.

The test results are illustrated in FIG. 2. In FIG. 2 a characteristic curve $\beta$ shows a relation between oxygen content and tensile strength, while a characteristic curve $\phi$ shows a relation between oxygen content and rate of reduction.

As shown in FIG. 2, when oxygen content is over 0.2%, the tensile strength becomes less than 23kg/mm$^2$ and the rate of reduction is less than 10%. For this reason, preferred oxygen content is less than 0.2%.

Having now fully described the invention, it will be apparent to one of ordinary skill in the art that many changes and modifications can be made thereto without departing from the spirit or scope of the invention as set forth herein.

What is claimed is:

1. A piston for an internal-combustion engine made by hot forging an extruded aluminium alloy comprising, by weight percent, less than 30% silicon, less than 8% iron, less than 7% copper, and less than 0.2% oxygen, the balance being substantially aluminium, wherein a test piece from a top portion of said piston exhibits a tensile strength not less than 23 kg/mm$^2$ with a rate of reduction of not less than 10%.

2. A piston for an internal combustion engine, the piston being composed of an aluminium alloy having excellent forgeability which is formed by consolidating an aluminium alloy powder by rapid cooling, the consolidated alloy comprising, by weight percent, less than 30% silicon, less than 8% iron, less than 7% copper, and less than 0.2% oxygen, the balance being substantially aluminium, wherein a test piece from a top portion of said piston exhibits a tensile strength not less than 23 kg/mm$^2$ with a rate of reduction of not less than 10%.

3. A piston according to claim 2, wherein the consolidated alloy consists essentially of 3% to 8% iron, 10% to 30% silicon, 2% to 7% copper, less than 0.2% oxygen, and the balance aluminium.

* * * * *